United States Patent [19]

Albrecht

[11] Patent Number: 4,638,680

[45] Date of Patent: Jan. 27, 1987

[54] BUCKET LINKAGE

[75] Inventor: Allan Albrecht, Rothschild, Wis.

[73] Assignee: J. I. Case Company, Racine, Wis.

[21] Appl. No.: 768,260

[22] Filed: Aug. 22, 1985

[51] Int. Cl.[4] ..... G05G 1/04

[52] U.S. Cl. ..... 74/516; 74/104

[58] Field of Search ..... 37/118 R, 103; 414/723, 414/697; 74/102, 104, 105, 106, 516

[56] References Cited

U.S. PATENT DOCUMENTS 4,046,026 9/1977 Hammarstrand ..... 414/697 X 4,381,167 4/1981 Baty ..... 414/723 X

*Primary Examiner*—Andrew V. Kundrat

*Attorney, Agent, or Firm*—Cullen, Sloman, Cantor, Grauer, Scott & Rutherford

[57] ABSTRACT

The present invention relates to the connection of a bucket to a boom arm in a manner that provides increased break out power and increased speed as the bucket travels through its operational cycle for overall increased ground removal. This is accomplished by offsetting the hinge point of the bucket relative to the standard pivot position and providing a modified linkage assembly that automatically adjusts the bucket radius as measured between the bucket and its hinge point.

2 Claims, 3 Drawing Figures

BUCKET LINKAGE

BACKGROUND OF THE INVENTION

The present invention relates to means for attaching an implement to a boom arm, and more particularly, to a linkage arrangement for attaching a bucket to a backhoe dipper stick in a manner which improves the overall performance characteristics of the bucket during operation.

Conventional backhoes have a bucket pivotally attached to the end of a boom arm or dipper stick at a point commonly referred to as the bucket hinge point, which is a point lying on the central longitudinal axis of the boom arm adjacent its end. A four bar linkage system is normally used for connecting the bucket to a hydraulic cylinder which controls the movement of the bucket about the hinge point. A typical four bar linkage system includes a first link which is pivotally attached at one end to the dipper stick at a spaced distance from the hinge point with its opposite end connected to a second link that is pivotally connected to the bucket. The connection point between the second link and bucket is referred to as the bucket power point. The third link corresponds to that portion of the bucket between the bucket power point and the bucket hinge point and the fourth link corresponds to that portion of the dipper stick between the hinge point and the pivot point of the first link on the dipper stick. This arrangement will normally permit the bucket to travel through a cycle of approximately 270°.

It is known that the performance characteristics of the bucket may be modified by repositioning the bucket power point with respect to the hinge point which changes the radius of bucket movement as measured between the hinge point and the power point. By increasing the radius, greater power or break out force can be obtained as the bucket enters the ground. By reducing the radius, the break out force is reduced but the bucket's speed is increased as it travels through the dig portion of the cycle. Therefore, by adjusting the bucket's radius (i.e., as measured between the hinge point and power point), the power of the bucket may be increased and the dig speed decreased or the dig speed may be increased and the break out power decreased when required. Typically, the optimum performance characteristics of a bucket will occur with a large break out force, i.e. greater power at the beginning of the bucket's rotation, and increasing dig speed as the bucket progresses through its cycle.

In an attempt to modify the performance characteristics of the bucket, it is known to manually reposition the bucket power point. To accomplish this, several power points are provided on a bucket and the push-pull link is disconnected and remounted to any one of the several points. A problem with the approach is the necessity of manually removing the linkages and repositioning them. Since the bucket is used in environments where dirt and the like builds on the bucket surfaces, it is difficult to reposition links in the field. A further problem with this system is that an optimum bucket performance is not obtainable because a dynamic combination of power and speed cannot be obtained. That is, higher break out forces or greater speeds can be obtained but not both at the same time.

Thus, there has been a need for an improved bucket linkage arrangement for attaching a bucket to a boom arm in a manner which improves the performance characteristics of the bucket during operation.

SUMMARY OF THE INVENTION

The present invention provides a bucket linkage that continually adjusts the bucket movement radius as the bucket rotates about the hinge point. This provides optimal performance characteristics for the bucket since the bucket radius is greatest at the start of rotation thereby providing greater break out forces, and the bucket radius continually decreases as the bucket continues through its cycle, thereby providing greater bucket speeds. Additionally, the hinge point is repositioned to provide an even greater bucket radius than that obtainable in conventional backhoes. The repositioned hinge point also permits larger areas of ground to be excavated during the bucket cycle.

In the first embodiment of the invention, the bucket hinge point is offset from the standard bucket hinge position. The conventional four bar linkage system is replaced by a modified linkage system which includes a first link pivotally attached at one end to the dipper stick at a spaced distance from the offset, a power link pivotally attached at one end to the standard bucket hinge point which has been replaced by the offset hinge point, a push-pull link interconnecting the ends of the first and power links, and a slave link connected between the push-pull link and the bucket. A hydraulic cylinder is connected between the first link and push-pull link to provide power to the linkage system and bucket. The bucket power point now corresponds to the connecting point between the power link, push-pull link, and slave link, and therefore, as the bucket rotates, this point continually moves closer to the offset hinge point giving greater break out forces with increasing speed as the bucket completes the cycle.

In a second embodiment of the present invention, a similar offset hinge point is provided with a modified linkage assembly. The modified linkage system includes a power link pivotally connected at one end to the standard bucket hinge point and a dipper stick link pivotally connected to one end of a push-pull link with the other end of the push-pull link connected to the other end of the power link. The slave link is replaced by a slot in the bucket that receives the pivot pin connecting the push-pull link and the power link, which then becomes the bucket power point. In the embodiment, the slot is substantially perpendicular to the arc of rotation of the bucket. By this arrangement, the power point pin slides along the slot as the bucket rotates thereby continually changing the bucket radius as measured between the bucket power point and the bucket hinge point.

DETAILED DESCRIPTION OF THE INVENTION

Figure 1:
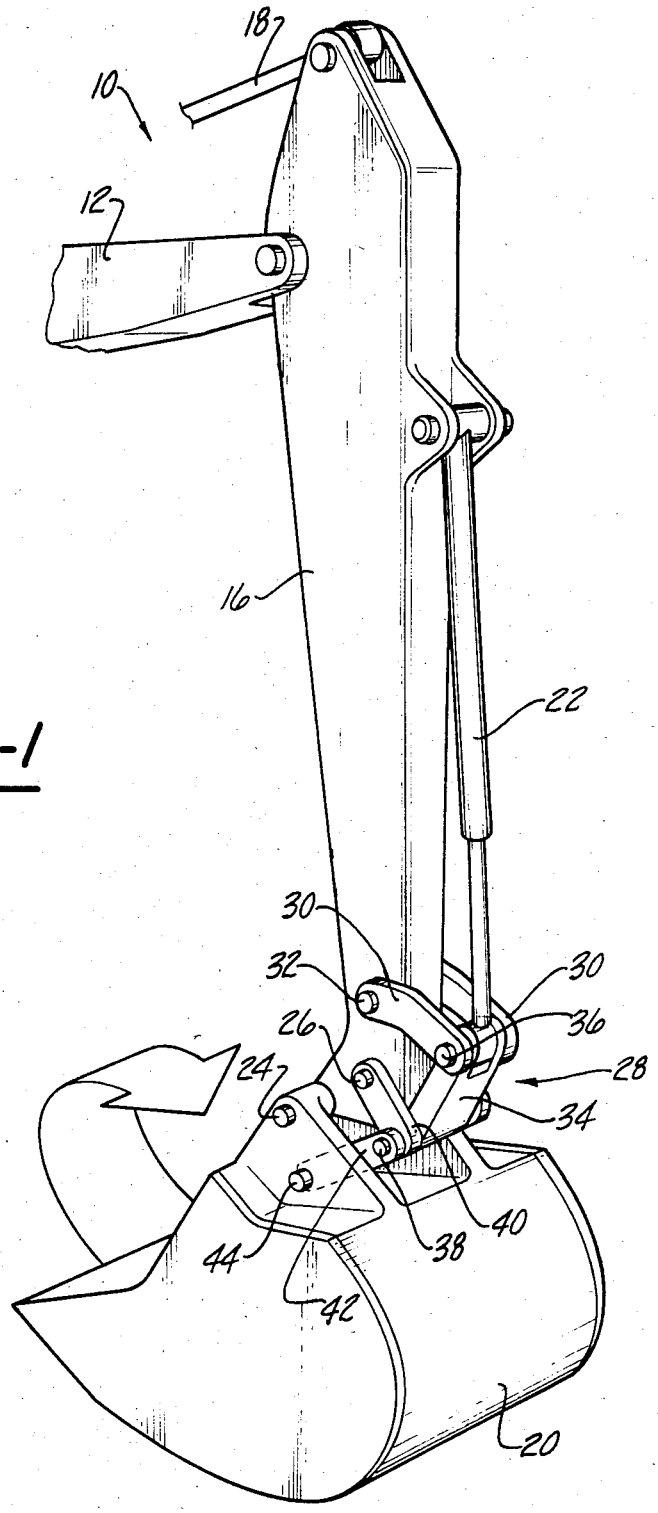
FIG. 1 is a partial perspective view of a backhoe including the first embodiment of the bucket linkage assembly of the present invention.
Figure 2:
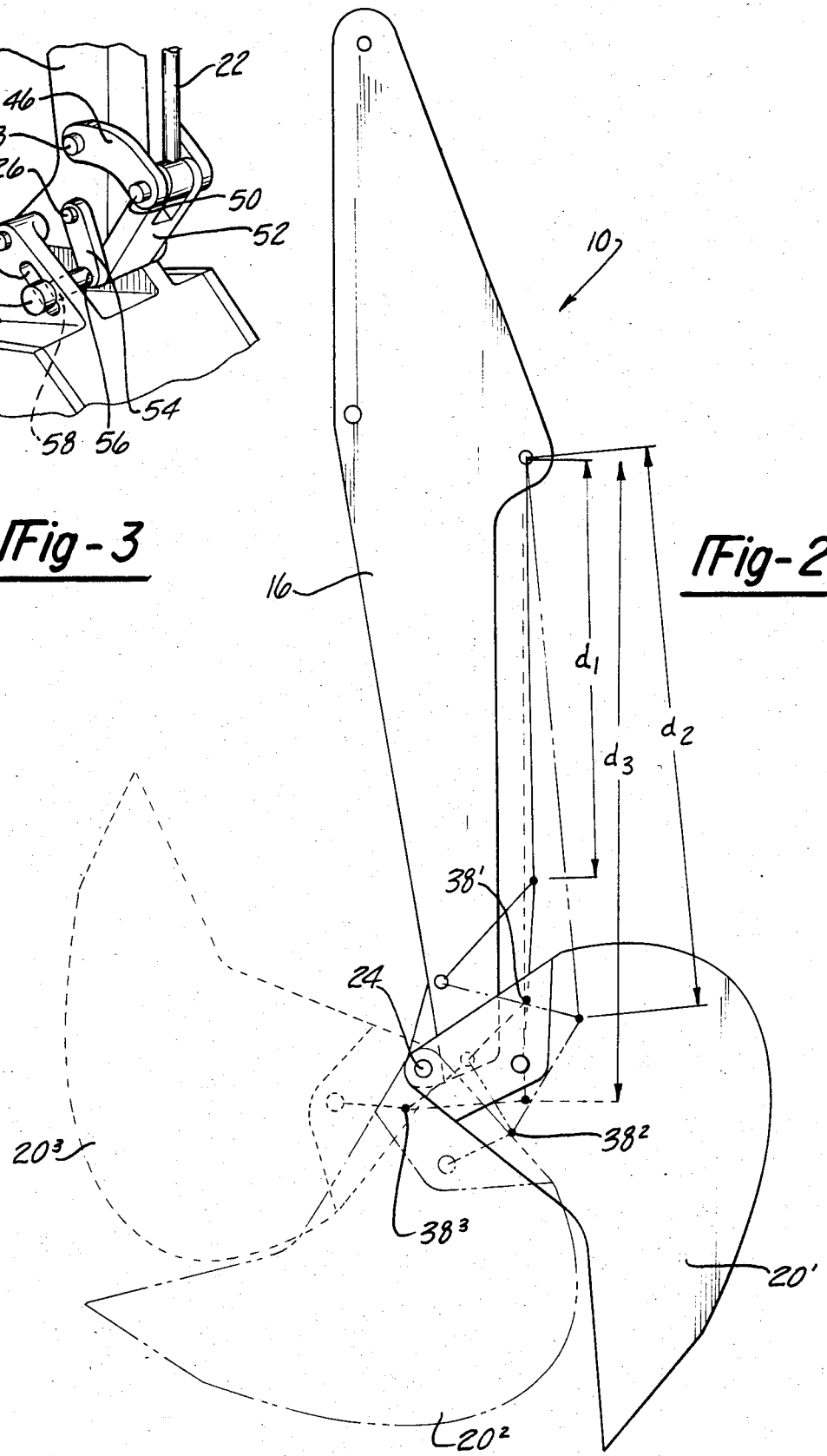
FIG. 2 is a side view of FIG. 1 illustrating the movement of the bucket linkage assembly.

With reference to FIGS. 1 and 2, a backhoe 10 is partially shown including a boom 12, a dipper stick 16 controlled by a hydraulic cylinder 18, and a bucket 20 controlled by a hydraulic cylinder 22.

Bucket 20 is hingedly attached to dipper stick 16 at an offset bucket hinge point 24 which is offset from the standard bucket hinge point shown at 26. In the preferred embodiment, offset bucket hinge point 24 is approximately 90° to the longitudinal center line of dipper stick 16. It will be apparent to those skilled in the art, that this location may be varied to other offset positions relative to the longitudinal center line of the dipper stick 16.

Hydraulic cylinder 22 is connected to bucket 20 through a linkage assembly 28 that includes first links 30 pivotally attached at one end to the dipper stick at pivot point 32 and at their opposite ends to a push-pull link 34 at pivot point 36. Pivotally attached at the opposite end of push-pull link 34 at pivot point 38 is a second link or power link 40 having its opposite end pivotally attached to the standard bucket hinge point 26. Pivot point 38 corresponds to what is referred to herein as the bucket power point. A fourth link or slave link 42 is connected at one end to power point 38 and at the opposite end to the bucket at pivot point 44.

As is apparent from FIG. 2, as bucket 20 is rotated about offset bucket hinge point 24 the distance between power point 38 and hinge point 24 continually decreases. When cylinder 22 is slightly extended to position $d^1$, bucket 20 is at position $20^1$ for entry into the surface to be excavated. Power point 38 is at $38^1$ to give the bucket greater break out force. As cylinder 22 is extended to position $d^2$, bucket 20 moves along the cycle to $20^2$ and point 38 moves to position $38^2$ continually moving closer to point 24. This corresponds to a reduction in power but an increase in speed. At position $d^3$ bucket 20 is completing is cycle and point 38 is at position $38^3$, very close to point 24, which corresponds to high rotation speeds.

Figure 3:
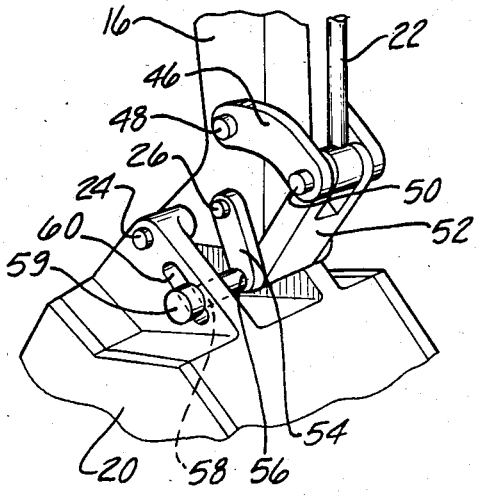
FIG. 3 is a partial perspective view of a backhoe including the second embodiment of the bucket linkage assembly of the present invention.

With reference to FIG. 3, a second embodiment of the present invention is illustrated. The second embodiment has dipper stick links 46 pivotally connected at pivot point 48 to dipper stick 16 and at pivot point 50 to push-pull link 52. Power links 54 are connected at one end to the standard bucket hinge point 26 and at the opposite end to link 52 at bucket power point 56.

Power point 56 includes an elongated pin 58 having a cap 59 which is received within an elongated slot 60 formed in bucket 20. As is apparent, as bucket 20 pivots about offset hinge point 24 power point 56 will reposition itself within elongated slot 60. Therefore, as the hydraulic cylinder 22 rotates bucket 20 the bucket radius is continually reduced as pin 58 slides within slot 60 toward pin 24.

It will be apparent to those skilled in the art that the foregoing disclosure is exemplary in nature rather than limiting the invention being limited only by the appended claims.

What is claimed is:

1. An attaching means for attaching a bucket to a boom arm for rotation about said arm between a first position and a second position, said attachment means comprising:

an offset hinge point on said arm positioned a predetermined distance from the longitudinal center line of said arm;

said bucket pivotally connected to said offset hinge point such that said bucket is rotatable about said arm; and a linkage system interconnecting said bucket to said arm, said system having a continually adjustable power point that automatically reduces the radius of bucket rotation as measured between said power point and said hinge point as said bucket rotates from said first position to said second position, thereby providing increased power at said first position and continually increasing the bucket speed as said bucket rotates to said second position; and said linkage system further comprising:

a first link pivotally connected at one end to said arm adjacent said offset, a second link pivotally connected at one end to said arm a spaced distance from said first link, and a third link pivotally interconnecting the opposite ends of said first and second links;

said first and third links connected by a pin which is received by and moveable within a slot formed in said bucket thereby forming said continually adjustable power point.

2. The attachment means of claim 1, wherein said slot is positioned substantially perpendicular to the arc of rotation of said bucket.

* * * * *